US006732619B2

(12) United States Patent
Carriere et al.

(10) Patent No.: US 6,732,619 B2
(45) Date of Patent: May 11, 2004

(54) CUTTER MECHANISM

(75) Inventors: Richard L. Carriere, Oak Creek, WI (US); Kevin L. Wilken, De Pere, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 4 days.

(21) Appl. No.: 10/002,363

(22) Filed: Nov. 1, 2001

(65) Prior Publication Data

US 2003/0079585 A1 May 1, 2003

(51) Int. Cl.[7] ..... B41J 11/70

(52) U.S. Cl. ..... 83/13; 83/568; 83/694; 400/593; 400/621; 101/93.07

(58) Field of Search ..... 83/13, 568, 628; 400/621, 593, 615.2, 88; 156/361, 186, 353, 384, 425, 468, 495, 523, 574; 33/63, 530, 360, 575, 582, 633, 697, 694, 879–881; 101/93.07, 288, 226, 224

(56) References Cited

U.S. PATENT DOCUMENTS

| | | | | | |
|---|---|---|---|---|---|
| 3,996,855 | A | | 12/1976 | Pabodie | |
| 4,211,498 | A | * | 7/1980 | Shimizu et al. | 400/621 |
| 4,248,112 | A | | 2/1981 | Clay | |
| 4,264,396 | A | | 4/1981 | Stewart | |
| 4,293,236 | A | * | 10/1981 | Shimizu | 400/593 |
| 4,302,119 | A | * | 11/1981 | Siegenthaler | 400/621 |
| 4,312,597 | A | | 1/1982 | Shimizu et al. | |
| 4,398,441 | A | * | 8/1983 | Jue | 83/575 |
| 4,407,692 | A | | 10/1983 | Torbeck | |
| 4,440,248 | A | | 4/1984 | Teraoka | |
| 4,473,426 | A | | 9/1984 | Goodwin et al. | |
| 4,477,305 | A | | 10/1984 | Hamisch, Jr. et al. | |
| 4,490,206 | A | | 12/1984 | Makley | |
| 4,497,682 | A | | 2/1985 | Hamisch | |
| 4,498,947 | A | | 2/1985 | Hamisch, Jr. et al. | |
| 4,501,224 | A | | 2/1985 | Shibayama et al. | |
| 4,511,422 | A | | 4/1985 | Hamisch, Jr. et al. | |
| 4,544,434 | A | | 10/1985 | Mistyurik | |
| 4,556,442 | A | | 12/1985 | Torbeck | |
| 4,630,538 | A | | 12/1986 | Cushman | |
| 4,655,129 | A | | 4/1987 | Wirth et al. | |
| 4,680,078 | A | | 7/1987 | Vanderpool et al. | |
| 4,844,629 | A | | 7/1989 | Hoyt | |
| 5,063,803 | A | | 11/1991 | Panneri et al. | |
| 5,078,523 | A | | 1/1992 | McGourty et al. | |
| 5,441,352 | A | * | 8/1995 | Shiota | 400/621 |
| 5,447,379 | A | * | 9/1995 | Pou | 400/88 |
| 5,613,788 | A | * | 3/1997 | Dobring | 400/621 |
| 5,746,527 | A | | 5/1998 | Nebashi et al. | |
| 5,971,639 | A | * | 10/1999 | Park | 400/621 |
| 6,113,293 | A | * | 9/2000 | Schanke et al. | 400/621 |
| 6,155,732 | A | | 12/2000 | Plasschaert et al. | |
| 6,182,730 | B1 | * | 2/2001 | Muir | 156/387 |
| 6,334,724 | B2 | * | 1/2002 | Yamaguchi et al. | 400/615.2 |
| 6,451,151 | B1 | * | 9/2002 | Traise | 156/264 |
| 6,511,240 | B2 | * | 1/2003 | Yamada | 400/594 |

OTHER PUBLICATIONS

US 4,561,048, 12/1985, Takamura et al. (withdrawn)

* cited by examiner

*Primary Examiner*—Allan N. Shoap
*Assistant Examiner*—Ghassem Alie
(74) *Attorney, Agent, or Firm*—Quarles & Brady LLP

(57) ABSTRACT

A cutter mechanism for use in a printer. The cutter mechanism includes a base and a cutter blade slidably fixed relative to the base. The cutter blade is movable along a cutting path in a first direction between a retracted position and a forward position through a cutting position. A breaker bar is fixed relative to the cutter blade, and is spaced from the cutter blade when the cutter blade is in the retracted position to define a web path between the breaker bar and the base. A first biasing member urges the blade in a second direction away from the breaker bar to completely disengage the blade from the breaker bar. The second direction is not parallel to the first direction.

16 Claims, 14 Drawing Sheets

FIG. 11
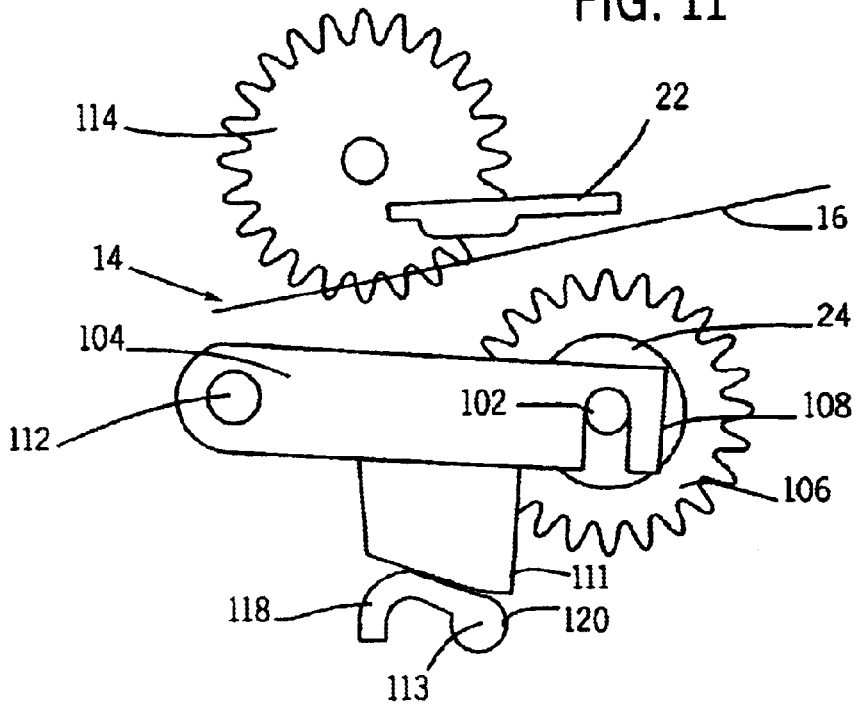
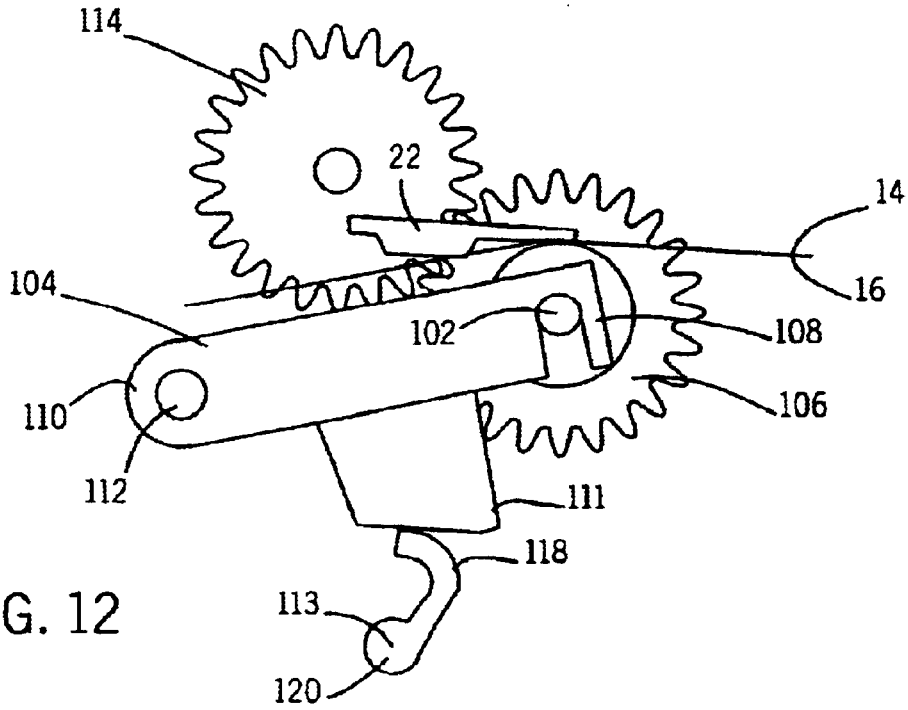
FIG. 12

CUTTER MECHANISM

CROSS REFERENCES TO RELATED APPLICATIONS

Not Applicable

STATEMENT REGARDING FEDERALLY SPONSORED RESEARCH

Not Applicable

TECHNICAL FIELD

The present invention relates to cutter mechanisms, and more particularly to a cutter mechanism for use in a thermal transfer printer, wherein the cutter mechanism has a cutter blade which completely disengages from a breaker bar.

DESCRIPTION OF THE BACKGROUND ART

There are a number of U.S. patents that disclose electronic apparatus for printing indicia on labels, some of these are restricted to hand held units and others that disclose tabletop units. Hand held labeling machines are disclosed, for example, in U.S. Pat. No. 4,264,396, Stewart; U.S. Pat. No. 4,407,692, Torbeck; U.S. Pat. No. 4,473,426, Goodwin et al.; U.S. Pat. No. 4,477,305, Hamisch; U.S. Pat. No. 4,490,206, Makely; U.S. Pat. No. 4,497,683, Hamisch; U.S. Pat. No. 4,498,947, Hamisch et al.; U.S. Pat. No. 4,511,422, Hamisch et al.; U.S. Pat. No. 4,544,434, Mistyurik; U.S. Pat. No. 4,556,442, Torbeck; U.S. Pat. No. 4,561,048, Hamisch et al.; and U.S. Pat. No. 4,680,078, Vanderpool et al. Tabletop units for this general purpose, some of which are portable are described in U.S. Pat. No. 4,440,248, Teraoka; U.S. Pat. No. 4,501,224, Shibayama; U.S. Pat. No. 4,630,538, Cushing; and U.S. Pat. No. 4,655,129, Wirth et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, and a visual display such as a LED, LCD unit to assist the operator in using the machine. In a hand held printer, these components may all be enclosed in a single housing.

The labeling media comprises a series of labels that are attached to a carrier strip. The carrier strip is fed through the printer and legends are printed on the labels. The labels are then removed from the carrier and attached to the objects needing identification. As there are many types of label applications, there are many combinations of labels and carrier strips that provide labels of varying sizes, colors and formats.

A particular type of print head employs thermal transfer printing technology. Thermal transfer printing uses a heat generating print head to transfer a pigment, such as wax, carbon black, or the like, from a thermal transfer ribbon to a labeling media. By using digital technology, characters are formed by energizing a sequence of pixels on the print head which in turn melt the wax or other pigment on the ribbon transferring the image to the labeling media.

Many prior art printers have various means and methods for separating printed labeling media from the unprinted labeling media. For example, U.S. Pat. No. 4,844,629, Hoyt, discloses a slot having a serrated edge that is used to tear the labeling media. A more complicated cutting mechanism, as disclosed in U.S. Pat. No. 5,078,523, McGourty et al, is composed of opposing cutting blades. In U.S. Pat. No. 5,078,523, an electric motor pivotally moves one blade across a fixed opposing blade to cut the labeling media.

In many cutter mechanisms having a cutter blade which engages a breaker bar, such as disclosed in U.S. Pat. No. 6,113,293, the cutter blade and breaker bar remain engaged to maintain a preload needed for consistent cutting. Advantageously, maintaining the cutter blade in engagement with the breaker bar also eliminates the possibility of the blade jamming into the breaker bar and allows a constant pressure to be maintained on the breaker bar by the blade. At least one lateral edge of the cutter blade is often extended to maintain the constant engagement and eliminate the possibility of the blade jamming into the breaker bar. Unfortunately, this extended edge increases the overall width of the cutter mechanism, and thus the cost. A need exists for a cutter mechanism suitable for use in a hand held printer which has a reduced overall width while minimizing the possibility of the cutter blade jamming into the breaker bar and which is capable of maintaining sufficient pressure against the breaker bar to efficiently cut labeling media.

SUMMARY OF THE INVENTION

The present invention provides a cutter mechanism for use in a printer. The cutter mechanism includes a base and a cutter blade slidably fixed relative to the base. The cutter blade is movable along a cutting path in a first direction between a retracted position and a forward position through a cutting position. A breaker bar is fixed relative to the cutter blade, and is spaced from the cutter blade when the cutter blade is in the retracted position to define a web path between the breaker bar and the base. A first biasing member urges the blade in a second direction away from the breaker bar to completely disengage the blade from the breaker bar. The second direction is not parallel to the first direction.

A general objective of the present invention is to minimize the cutter width. This objective is accomplished by completely disengaging the cutter blade from the breaker bar when the cutter blade is in the retracted position.

Another objective of the present invention is to guide the cutter blade such that the cuter blade does not jam into the breaker bar while maintaining sufficient pressure against the breaker bar to efficiently cut labeling media. This objective is accomplished by urging the cutter blade away from the breaker bar until the blade overlaps the breaker bar.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 11 is a detailed top view of the cartridge mechanism assembly of FIG. 3 with the platen roller in the nonprinting position;

FIG. 12 is a detailed top view of the printer mechanism assembly of FIG. 4 with the platen roller in the printing position;

DETAILED DESCRIPTION OF THE PREFERRED EMBODIMENTS

Figure 1:
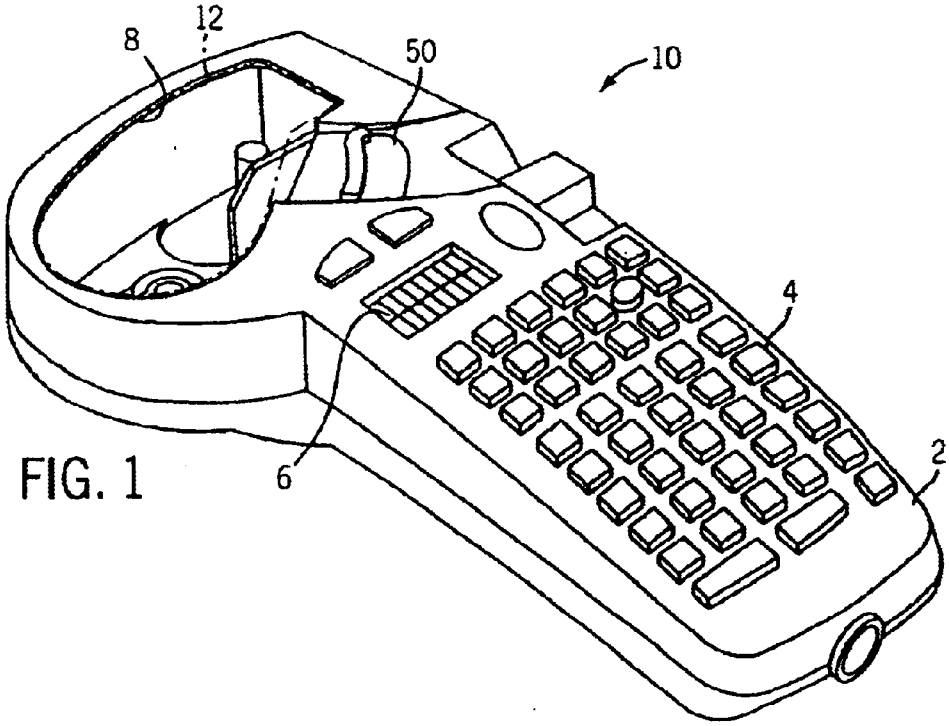
FIG. 1 is a perspective view of a hand held label printer which employs the present invention.
Figure 2:
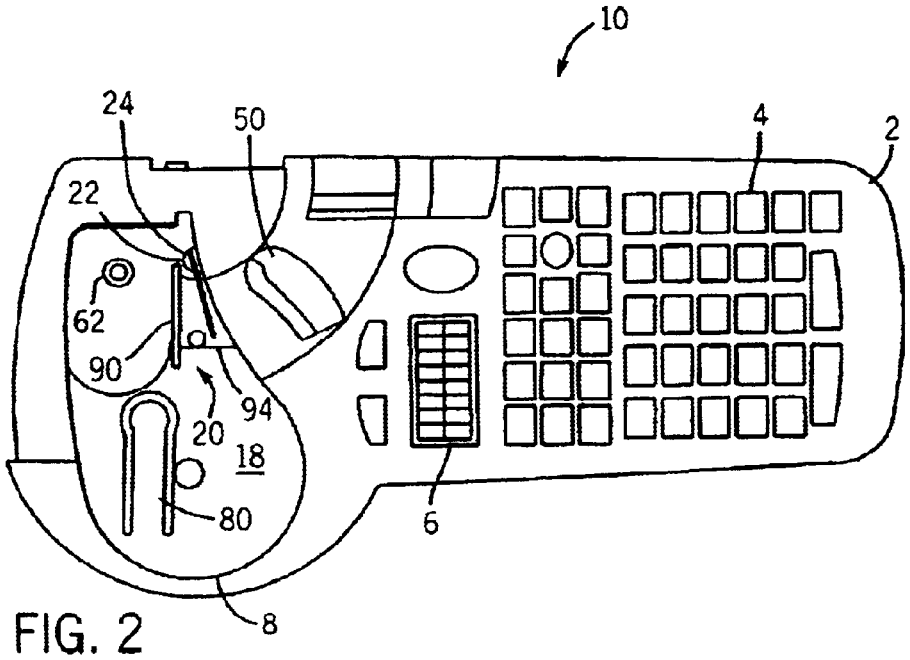
FIG. 2 is a top view of the printer of FIG. 1 with the cartridge removed.
Figure 3:
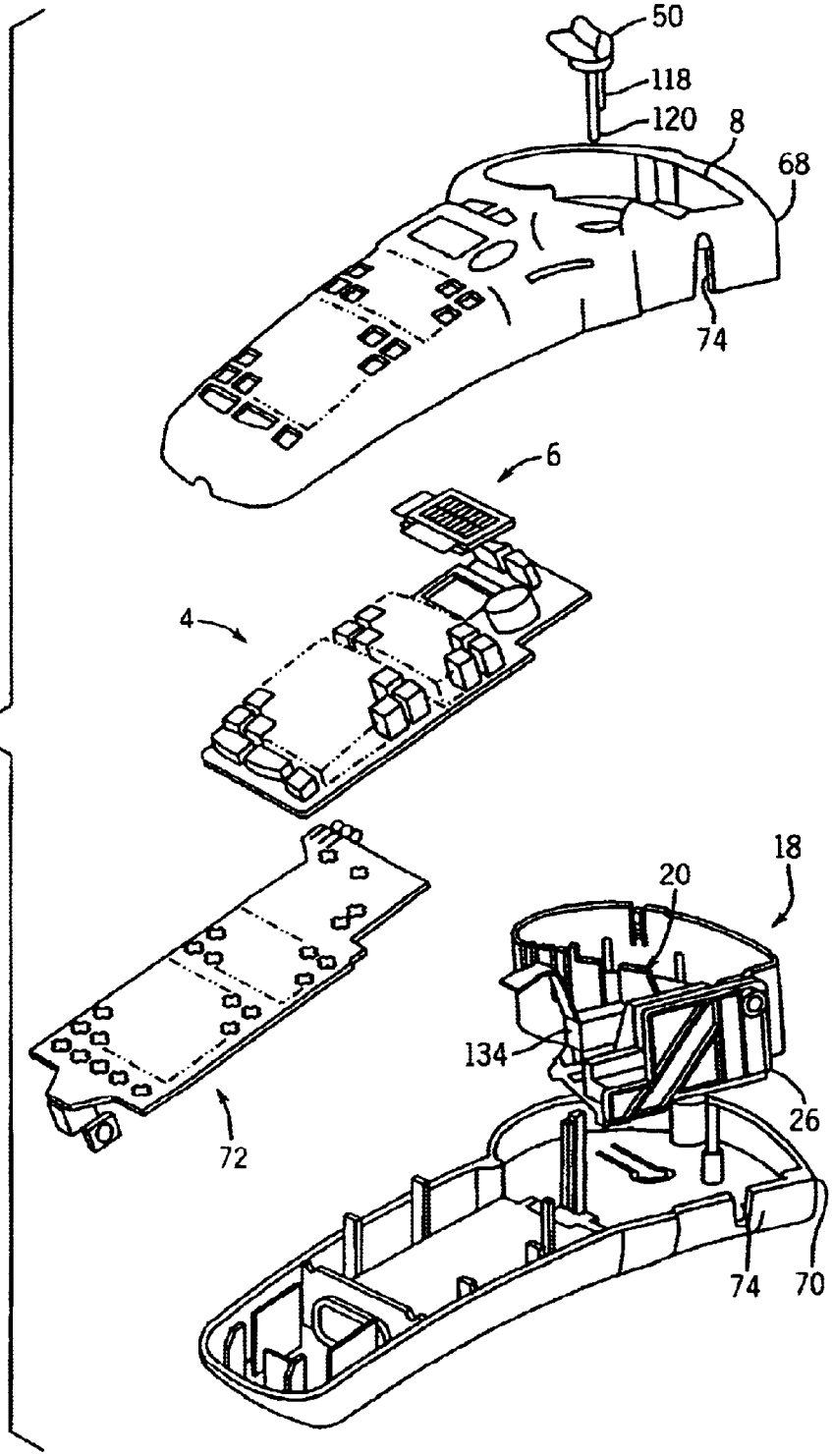
FIG. 3 is an exploded perspective view of the printer of FIG. 2.
Figure 4:
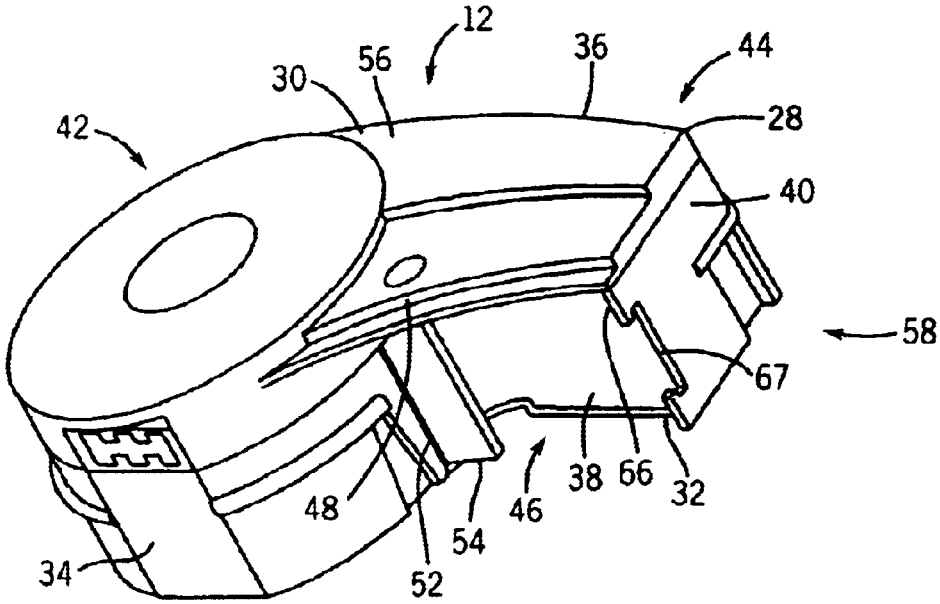
FIG. 4 is a top perspective view of the cartridge of FIG. 1.
Figure 5:
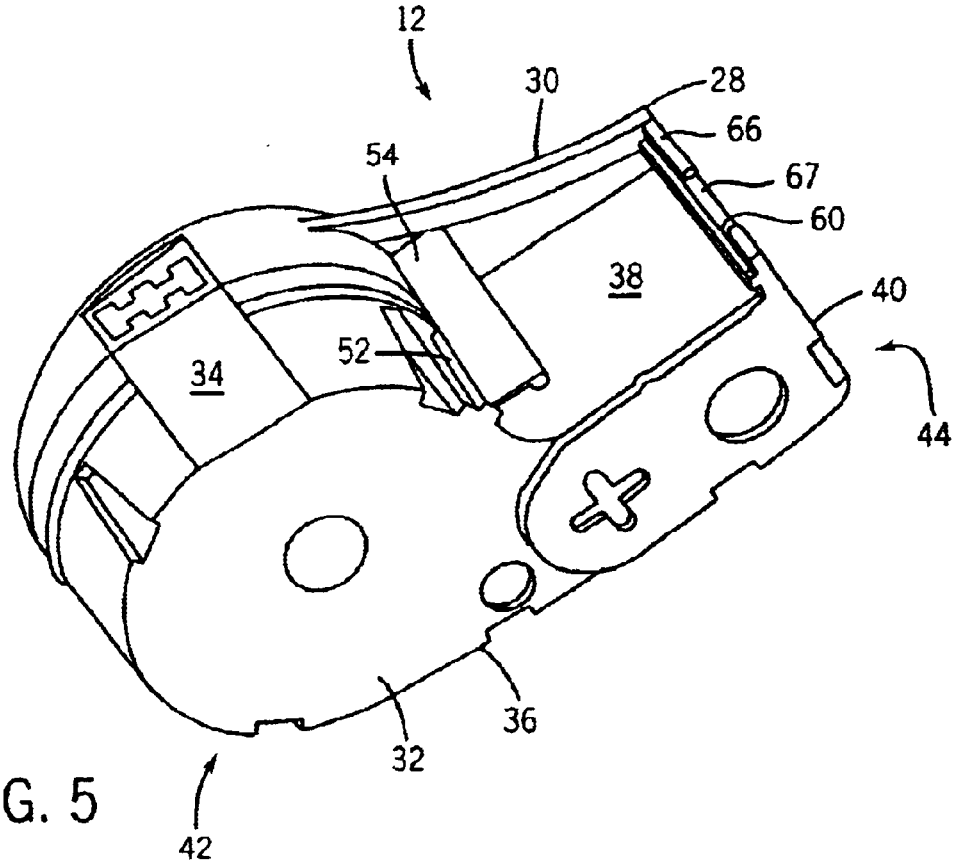
FIG. 5 is a bottom perspective view of the cartridge of FIG. 1.
Figure 6:
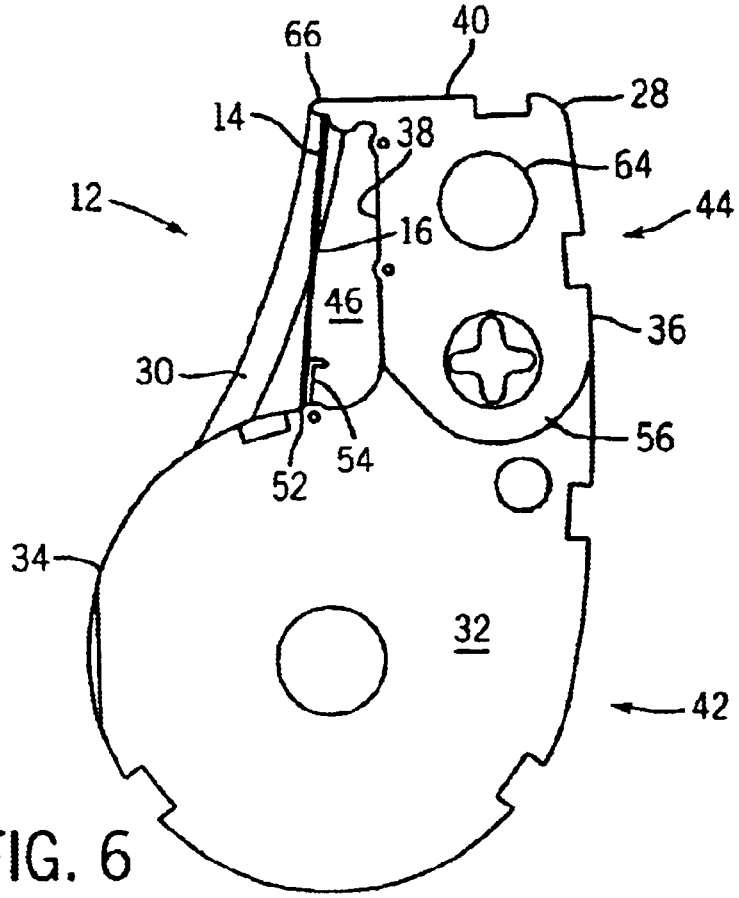
FIG. 6 is a bottom view of the cartridge of FIG. 1.
Figure 9:
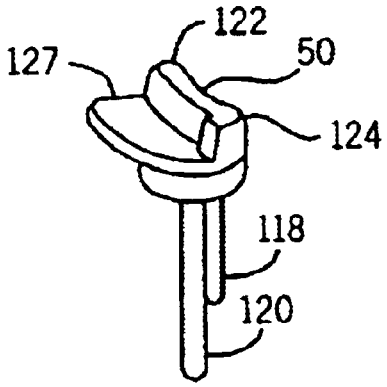
FIG. 9 is a perspective view of the camshaft, cam and lever of FIG. 3.
Figure 7:
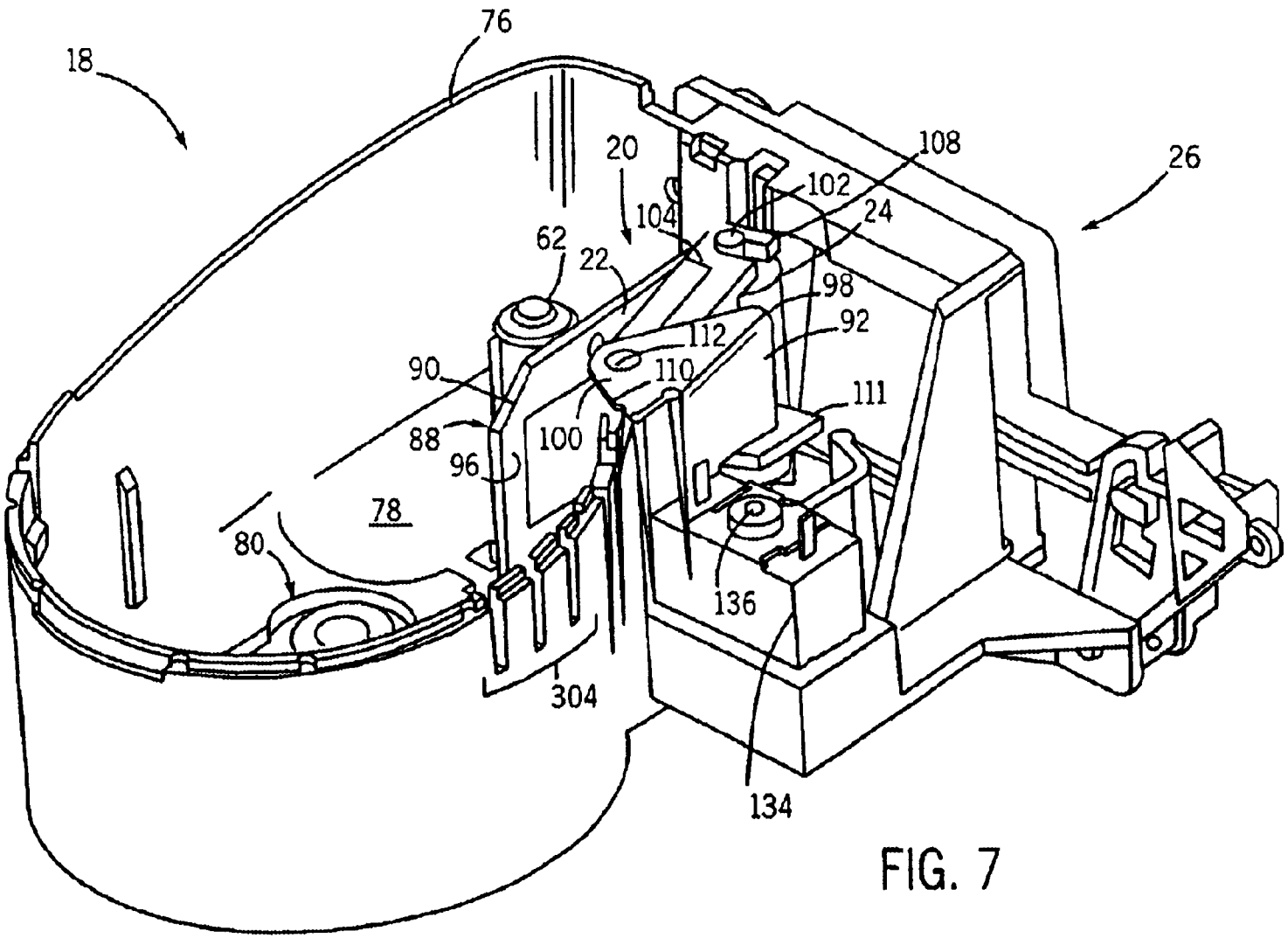
FIG. 7 is a top perspective view of the cartridge receptacle of the printer of FIG. 2.
Figure 8:
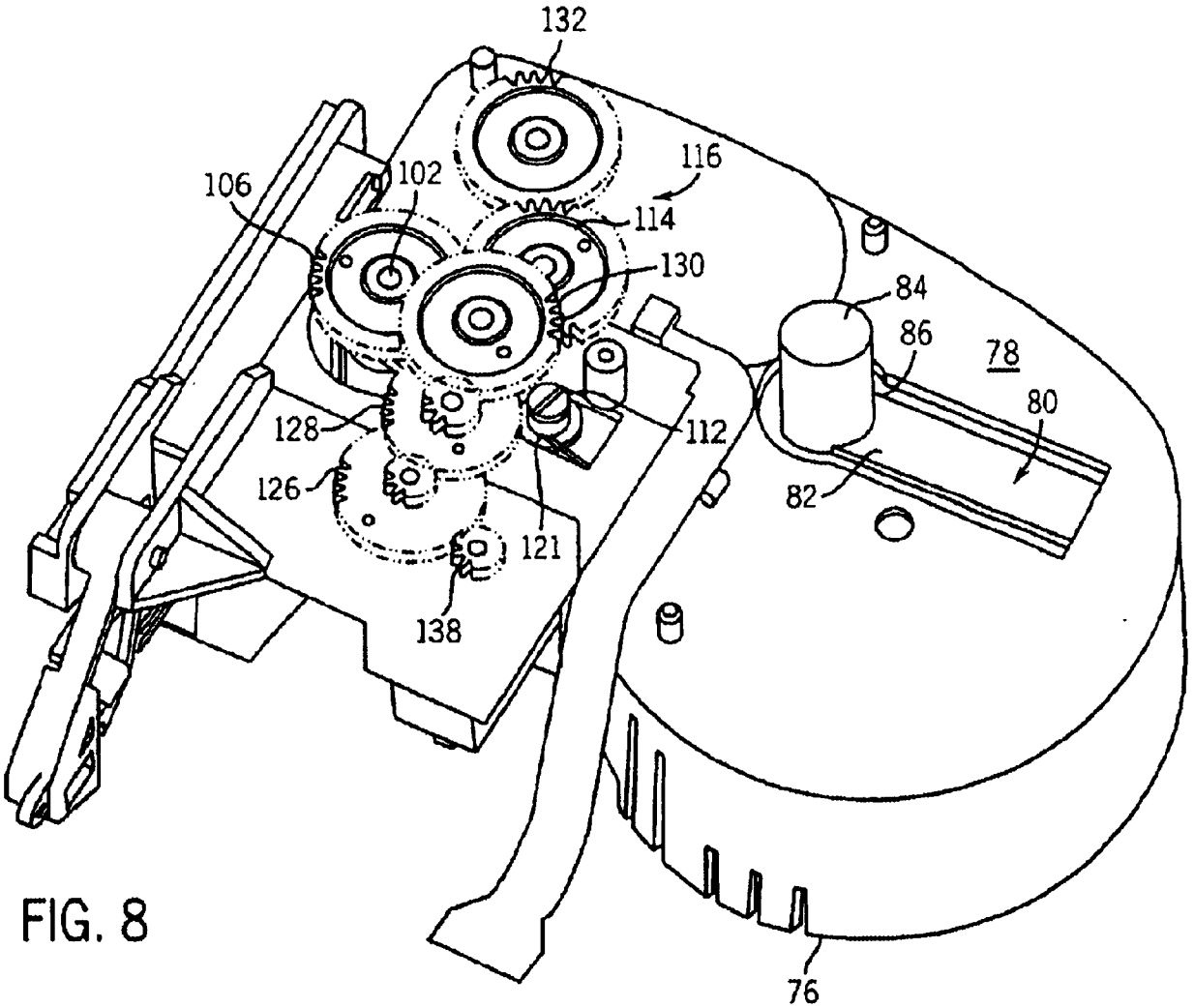
FIG. 8 is a bottom perspective view of the cartridge receptacle of FIG. 7.

Referring particularly to FIGS. 1–3, a thermal printing machine 10 which employs the preferred embodiment of the present invention includes a molded plastic housing 2 that supports a keyboard 4 on its front surface and a display 6 positioned above the keyboard 4. An opening 8 formed in the housing 2 above the display 6 receives a cartridge 12 containing labeling media 14 and an ink ribbon 16 (shown in FIG. 6). The cartridge 12 is inserted through the opening 8 into a cartridge receptacle 18 housed in the printer housing 2, and the labeling media 14 and ink ribbon 16 from the cartridge are threaded through a printer mechanism assembly 20 including a print head 22 and roller platen 24 for printing indicia on labels forming part of the labeling media 14. The printed labels pass through a cutter mechanism 26 which cuts the labeling media to separate the printed labels from unprinted labels.

The labeling media 14 is known in the art, and generally comprises a carrier web which supports a series of adhesive labels. The size, width, color, and type of web material varies depending upon the particular print application. The labeling media is dispensed from the cartridge 12, and urged along a web path as it is consumed by the printer 10.

Referring to FIGS. 3–7, the cartridge 12 includes a cartridge housing 28 having a top wall 30 and a bottom wall 32 joined by periphery walls 34, 36, 38, 40. The periphery walls 34, 36, 38, 40 define a semi circular labeling media container 42 and a rectangular ink ribbon container 44 joined to the labeling media container 42. The top wall 30 extends past the periphery walls 34, 38, and defines a printing area 46 outside of the housing periphery walls 34, 38 at the junction of the labeling media container 42 and ink ribbon container 44. Labeling media 14 and ink ribbon 16 from inside the cartridge housing 28 pass through the printing area 46 for engagement with the roller platen 24 and print head 22. A shelf 48 formed along one edge of the top wall 30 is flush with the printer opening 8 to allow engagement of the shelf 48 with a lever 50 which locks the cartridge 12 in the receptacle 18.

The labeling media container 42 receives the labeling media 14 in the form of a roll. An exit slot 52 formed in the periphery wall 34 defining the labeling media container 42 opens into the printing area 46, and provides an exit for the labeling media 14 and ink ribbon 16 to pass out of the cartridge housing 28 and into the printing area 46. A projection 54 extending adjacent to the exit slot 52 guides the labeling media 14 and ink ribbon 16 as they exit the cartridge 12 through the exit slot 52.

The ink ribbon container 44 extends tangentially from the semicircular labeling media container 42, and has a proximal end 56 which opens into the labeling media container 42 and an opposing, closed, distal end 58 joined by the exterior periphery wall 36 which is a tangential extension of the labeling media container periphery wall 34. The interior ink ribbon periphery wall 38 extending between the proximal and distal ends 56, 58 is spaced from the ink ribbon exterior periphery wall 36, and defines a boundary of the printing area 46. Ink ribbon 16 which has passed through the printing area 46 reenters the ink ribbon container 44 through an entrance slot 60 formed at the junction of the interior ink ribbon periphery wall 38 and the ink ribbon container periphery end wall 40.

An ink ribbon supply spool (not shown) is supported between the top and bottom walls 30, 32 of the cartridge housing 28, and has a roll of ink ribbon 16 wound thereon. The ink ribbon 16 is unwound from the supply spool, and passes out of the cartridge 12 with the labeling media 14 through the exit slot 52. The ink ribbon 16 reenters the cartridge 12 through the entrance slot 60, and is wound onto an ink ribbon take up spool (not shown).

The take up spool is supported between the cartridge housing top and bottom walls 30, 32, and is rotatably driven by an ink ribbon drive shaft 62 which extends through an opening 64 formed in the cartridge bottom wall 32. The shaft 62 engages the take up spool to rotatably drive the spool and wind the ink ribbon 16 thereon.

A labeling media guide 66 is formed at the ink ribbon container distal end 58, and extends perpendicular to the interior ink ribbon periphery wall 38. A guiding slot 67 formed in the guide 66 directs the labeling media 14 which has passed through the printing area 46 toward the cutter mechanism 26.

Referring back to FIGS. 1–3, the cartridge 12 is received in the cartridge receptacle 18 housed in the printer housing 2. The printer housing 2 is, preferably, formed from two halves 68, 70, and houses printer components, such as the cartridge receptacle 18, the keyboard 4, display 6, the cutter mechanism 26, a printed circuit board 72 having printer circuitry, and the like. The opening 8 formed in the housing top half 68 provides access to the cartridge receptacle 18 for insertion of the cartridge 12 into the receptacle 18. A slot 74 formed in the housing 2 adjacent the cutter mechanism 26 provides an exit for labeling media 14 (FIG. 6) which has passed through the cutter mechanism 26.

Referring to FIGS. 6–12, the cartridge receptacle 18 has a sidewall 76 generally shaped to conform with the cartridge periphery walls 34, 36, 38, 40, and a floor 78 which supports the cartridge 12 therein. An eject mechanism 80 is formed as an integral part of the receptacle floor 78, and includes a cantilevered arm 82 with a button 84 extending perpendicular to the arm 82 from the arm distal end 86. The button 84 extends away from the receptacle floor 78 through the printer housing 2 for engagement by a user. The user urges the button 84 toward the receptacle 18 to engage the arm 82 with the cartridge 12 and push the cartridge 12 out of the receptacle 18.

The printer mechanism assembly 20 is fixed to the printer receptacle 18, and includes the stationary print head 22 and pivotable platen roller 24 mounted on a U-shaped frame 88. The U-shaped frame 88 includes two upwardly extending legs 90, 92 joined by a base 94 (FIG. 2). One leg 90 has an inwardly facing surface 96 for mounting the print head 22 thereon. The opposing leg 92 has a distal end 98 with a tab 100 extending inwardly toward the one leg 90. Preferably, the frame 88 is fixed to the receptacle 18 with screws 91. However, any method known in the art for fixing a frame to a another object, such as rivets, bonding, and the like, can be used without departing from the scope of the present invention.

The fixed thermal print head 22 is mounted to the inwardly facing surface 96 of the leg, and extends into the cartridge printing area 46 when the cartridge 12 is received in the receptacle 18. The print head 22 cooperates with the ink ribbon 16 and the labeling media 14 such that the print head 22 can print characters or symbols on the labeling media. This is described in greater detail in U.S. Pat. No. 5,078,523 which is incorporated herein by reference. The labeling media 14 and ink ribbon 16 passing through the printing area 46 are advanced past the print head 22 by the platen roller 24 which maintains the ribbon 16 and labeling media 14 in close cooperation with the print head 22.

The platen roller 24 is mounted on a roller shaft 102 which is rotatably fixed to an end 108 of a pivot linkage 104. One end of the drive shaft extends through the receptacle floor 78. A drive gear 106 is fixed to the one end of the shaft 102, and is coaxial with the platen roller 24. The drive gear 106 engages a stationary gear 114 which is rotatably mounted to the underside of the receptacle floor 78. The stationary gear 114 forms part of a gear assembly 116, and meshes with the drive gear 106 to rotatably drive the platen roller 24.

The pivot linkage 104 has an opposing end 110 pivotally fixed to a pin 112 supported between the frame tab 100 and base 94 (FIG. 2). The pivot linkage 104 pivots about the pin 112 to move the platen roller 24 between a printing position (shown in FIG. 12) and a nonprinting position (shown in FIG. 11) and to engage and disengage the drive gear 106 from the stationary gear 114. A cam follower 111 extending from the pivot linkage 104 between the linkage ends 108, 110 engages a cam 118 to pivot the linkage 104 about the pin 112. Although fixing the pivot linkage 104 to the pin 112 supported between the frame tab 100 and base 94 (FIG. 2) is disclosed, other methods for movably mounting the platen roller relative to the print head, such as slidably mounting the roller shaft in a slot formed in the housing and the like, can be used without departing from the scope of the present invention.

As shown in FIG. 12, when the pivot linkage 104 pivots to move the platen roller 24 to the printing position, the drive gear 106 engages a rotatably driven stationary gear 114 to rotatably drive the platen roller 24, and the platen roller 24 extends into the receptacle 18 (FIG. 7) and urges the labeling media 14 and ink ribbon 16 against the print head 22. In the nonprinting position shown in FIG. 11, the drive gear 106 is disengaged from the stationary gear 114, and the platen roller 24 is spaced from the print head 22 to allow insertion of the labeling media 14 and ink ribbon 16 therebetween.

Referring to FIGS. 2–4, 8–12, the cam 118 engages the pivot linkage 104 to move the platen roller from the nonprinting position to the printing position and to engage and disengage the drive gear 106 with the stationary gear 114. A spring 121 wrapped around one end of the pin 112 biases the linkage 104 against the cam 118 to bias the pivot linkage 104 away from the platen roller printing position. The cam 118 is fixed to a cam shaft 120 which is rotated about a cam shaft axis 113 by the lever 50 fixed to an end of the cam shaft 120 extending through the printer housing 2.

Figure 13:
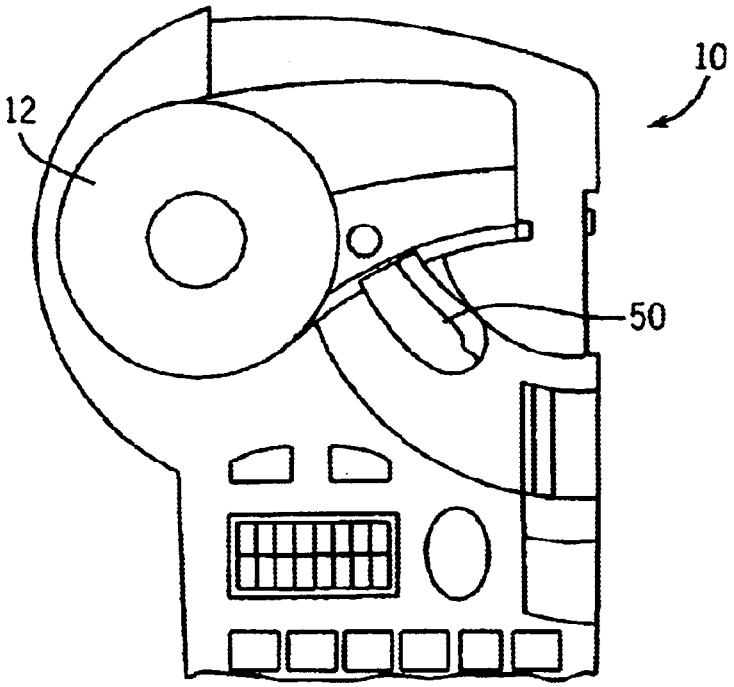
FIG. 13 is a front view of the printer of FIG. 1 with the lever in the lock position.

The elongated lever 50 has one end 124 fixed to the cam shaft 120, and is pivotable about the cam shaft axis 113 (shown in FIGS. 11 and 12) between a lock position (shown in FIG. 13) and an unlock position (shown in FIG. 1). Pivoting the lever 50 about the cam shaft axis 113 between the lock and unlock positions, rotates the camshaft 120 to engage and disengage the cam 118 from the pivot linkage 104. Advantageously, in the lock position, the lever opposed end 127 extends over the receptacle 18, and engages the top wall shelf 48 of the cartridge 12 to lock the cartridge 12 in the receptacle 18. In the unlock position, the lever 50 is disengaged from the cartridge 12, and allows the cartridge 12 into or out of the receptacle 18. Preferably, the lever 50 includes a rib 122 extending along a lever edge to provide an engagement surface for a user to easily engage the lever 50 to pivot it about the cam shaft axis 113.

Referring back to FIGS. 7 and 8, the gear assembly 116 includes a plurality of intermeshed gears 114, 126, 128, 130, 132 rotatably mounted to the underside of the receptacle floor 78. The gear assembly 116 is rotatably driven by a motor 134 fixed to the receptacle 18. The motor 134 includes a shaft 136 which extends through the receptacle floor 78, and has a pinion 138 fixed to the shaft 136 which meshes with the gear assembly 116. The printer circuitry energizes the motor 134 to rotatably drive the shaft 136, and thus the stationary gear 114.

One of the plurality of intermeshed gears 132 is fixed to and coaxial with the ink ribbon drive shaft 62 which extends through the receptacle floor 78 to rotatably drive the ink ribbon take up spool. Advantageously, the gear assembly 116 simultaneously drives the platen roller 24 and ink ribbon drive shaft 62 to synchronize the operation of the platen roller 24 and ink ribbon take up spool to smoothly urge the ink ribbon 16 (FIG. 6) and labeling media 14 (FIG. 6) along the web path.

Referring to FIGS. 1, 4, 7, 11, and 12, once the cartridge 12 is locked in place, the platen roller 24 is in the printing position, and the drive gear 106 is engaged with the stationary gear 114, the printing machine 10 is ready to produce printed labels. When printing on the labels, the platen roller 24 and a take up spool advance the labeling media 14 and ink ribbon 16 through the printing area 46 past the print head 22. When a desired character is input by an operator or other means, the electronics of the machine 10 energizes pixels on the print head 22 as the labeling media 14 and ink ribbon 16 advance past the head 22. The head pixels are variously energized to imprint the character on the labeling media 14. This is described in greater detail in U.S. Pat. No. 5,078,523 which has been incorporated herein by reference.

After printing, labeling media 14 advances to a "cut" position, at which time, the operator manually actuates the cutting mechanism 26 to separate the labeling media 14 containing printed labels from the unused portion. As shown in FIG. 3, the cutting mechanism 26 is disposed adjacent the printing mechanism 20 at the end of the web. Labeling media 14 fed into the cutting mechanism 26 is cut by a blade 140 (FIG. 10) disposed within the cutting mechanism 26. The cut position exposes the printed labels to the operator through the slot 74 in the printer housing 2. Once the operator actuates the cutting mechanism 26, the labels are retrieved by the operator for use.

As shown in FIGS. 10, 14–21, the cutting mechanism 26 includes the blade 140 fixed in a blade carriage 142 and slidably mounted on a base 144. The blade carriage 142 urges the blade 140 toward the base 144 along a cutting path between a retracted position and a forward position. Between the retracted position and forward position, the blade 140 has a cutting position in which the blade 140 overlaps and engages a breaker bar 146 to cut the labeling media 14. A cover 148 is fixed to the base 144 sandwiching the blade 140 and carriage 142 therebetween.

The generally rectangular base 144 is preferably formed as an integral part of the receptacle sidewall 76, and has a pair of opposing sidewalls 150 joined by cross members 152, 154. Runners 158, 160 formed along at least a portion of each base sidewall 150 slidably support the blade 140. A longitudinal ridge 162 formed on one runner 158 engages the blade 140 to maintain the blade 140 at an angle A (shown in FIG. 19) to the breaker bar 146 during the cutting operation. A projection 164 formed at a forward end of the ridge 162 engages the blade 140 to urge the blade 140 away from the breaker bar 146 in a direction perpendicular to the longitudinal direction of the blade movement.

The breaker bar 146 is mounted over the base forward cross member 154, and cooperates with the blade 140 to cleanly cut the labeling media 14. The breaker bar 146 is received in apertures 165 formed in the base sidewalls 150 to fix the breaker bar 146 relative to the blade 140. Although forming apertures 165 in the base 144 to receive the breaker bar 146 is disclosed, other methods for fixing the breaker bar relative to the blade can be used, such as molding the breaker bar to the base, bonding the breaker bar to a fixed component using adhesives, screws, and the like, without departing from the scope of the present invention. Preferably, the breaker bar 146 is tipped to engage the blade 140 with an edge 167 to define a sharp cutting plane.

Referring to FIGS. 14, 18–21, the cutter blade 140 is slidably mounted to the base 144 for forwardly and rearwardly movement along the cutting path in the longitudinal direction between the forward position and retracted position. The metal blade 140 has a cutting edge 166 and a rear edge 168 joined by lateral edges 170, 172. Preferably, the sharpened cutting edge 166 defines an angle B (shown in FIG. 18) with the breaker bar 146 to define a leading cutting edge corner 174 which engages the breaker bar 146 in the cutting position (shown in FIG. 20) prior to a trailing cutting edge corner 176 when the blade 140 is moving from the retracted position to the forward position in the longitudinal direction. Most preferably, the blade lateral edge 170 defining the leading edge corner 174 engages the longitudinal ridge 162 formed in the runner 158 to define the angle A with the breaker bar 146. Notches 178 formed in each lateral edge 170, 172 receive tabs 180 extending from the blade carriage 142 (FIG. 14) to fix the blade 140 relative to the carriage 142 in the longitudinal direction.

A slot 182 is formed in the blade 140 adjacent the lateral edge 170 defining the leading cutting edge corner 174. The slot 182 receives the projection 164 extending from the base 144 to disengage the projection from the blade, and allow movement of the blade 140 in a direction other than the longitudinal direction, such as perpendicular to the longitudinal direction, to engage and disengage the cutter blade 140 with the breaker bar 146. Preferably, a ramp 185 is formed at the leading end 186 of the slot 182 to provide a smooth transition for the projection 164 into and out of the slot 182. Most preferably, the projection 164 is received in the slot 182 only when the blade 140 overlaps the breaker bar 146 to ensure the blade 140 does not jam into the breaker bar 146 ceasing movement of the blade 140 in the longitudinal direction. Although a slot 182 formed in the blade 140 for receiving the projection 164 formed in the base 144 is disclosed, other methods for moving the blade 140 relative to the longitudinal direction can be used, such as forming a slot in the base which receives a projection on the blade, without departing from the scope of the present invention.

By forming the slot 182 in the blade 140 for engagement with the projection 164, the blade 140 pivots about the lateral edge 172 defining the trailing cutting edge 176 corner as the projection 164 moves into and out of the slot 182. Advantageously, moving the blade 140 in a direction which is not parallel to the longitudinal direction of the blade 140 allows the blade 140 to engage and disengage the breaker bar 146 while minimizing the possibility of jamming the blade 140 into the breaker bar 146 when from the retracted position to the forward position. In addition, when the projection 164 is received in the slot 182, the blade 140 can be urged against the breaker bar 146 to maintain sufficient pressure against the breaker bar 146 to efficiently cut the labeling media 14 during the cutting operation.

Figure 14:
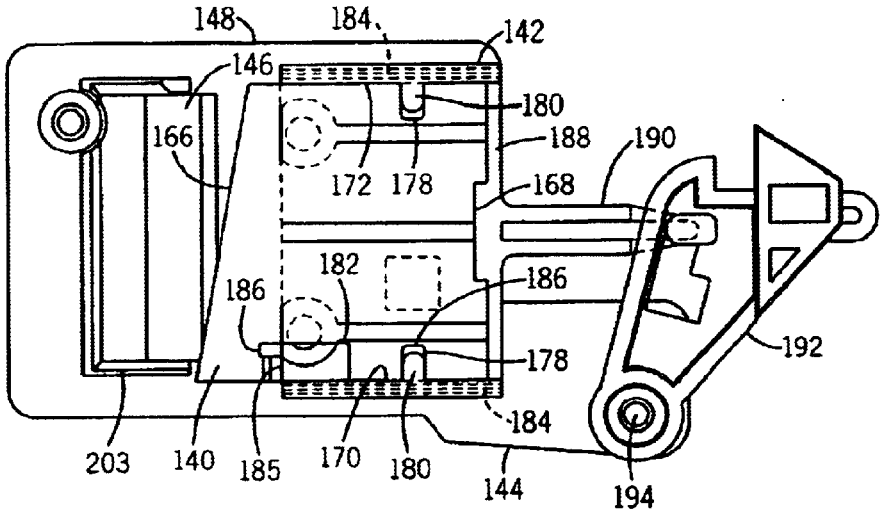
FIG. 14 is a sectional view of the cutter mechanism of FIG. 3 looking from the cutter base toward the cutter blade.

As shown in FIG. 14, the blade carriage 142 urges the blade 140 between the retracted position and the forward position in the longitudinal direction, and includes sidewalls 184 joined by a top wall 186 and a rear wall 188. The tabs 180 extend inwardly from the carriage sidewalls 184, and are received in the notches 178 formed in the blade 140 to fix the blade 140 relative to the carriage 142 in the longitudinal direction while allowing the blade 140 to move freely in a direction substantially perpendicular to the longitudinal direction. A tail 190 extends rearwardly from the rear wall 188 and engages a pivot arm 192 which drives the blade carriage 142 in the longitudinal direction.

Figure 10:
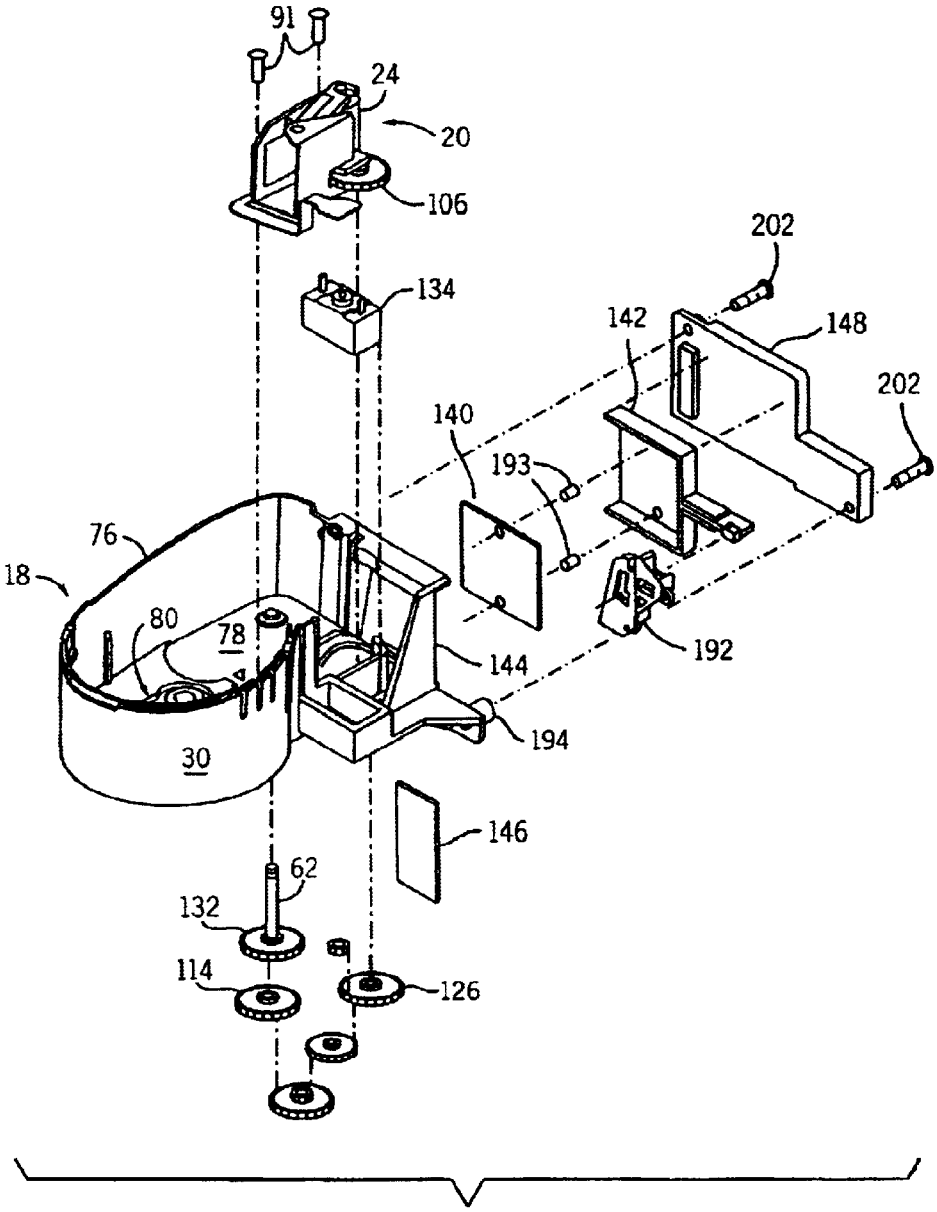
FIG. 10 is an exploded perspective view of the cartridge receptacle and cutter mechanism of FIG. 3.

Compressed helical springs 193, shown in FIG. 10, interposed between the blade carriage 142 and blade 140 urge the blade 140 toward the base 144 in a direction perpendicular to the longitudinal direction to ensure the blade 140 positively contacts the breaker bar 146 in the cutting position. Although a pair of compressed helical springs 193 is disclosed, other means for biasing the blade 140 toward the base 144 can be used, such as a leaf spring, compressible pad, and the like, without departing from the scope of the present invention.

The pivot arm 192 is linked to the blade carriage tail 190 (FIG. 14), and drives the blade carriage 142 in the longitudinal direction. The pivot arm 192 is pivotally mounted to the cutter mechanism base 144 on a pin 194 extending from the base 144. A lever arm 196 (shown in FIG. 17) linked to the pivot arm 192 is engageable by a user. Actuation of the lever arm 196 by urging the lever arm 196 in a forwardly direction pivots the pivot arm 192 about the pin 194 to longitudinally drive the blade carriage 142, and thus the blade 140 in the longitudinal direction.

Figure 17:
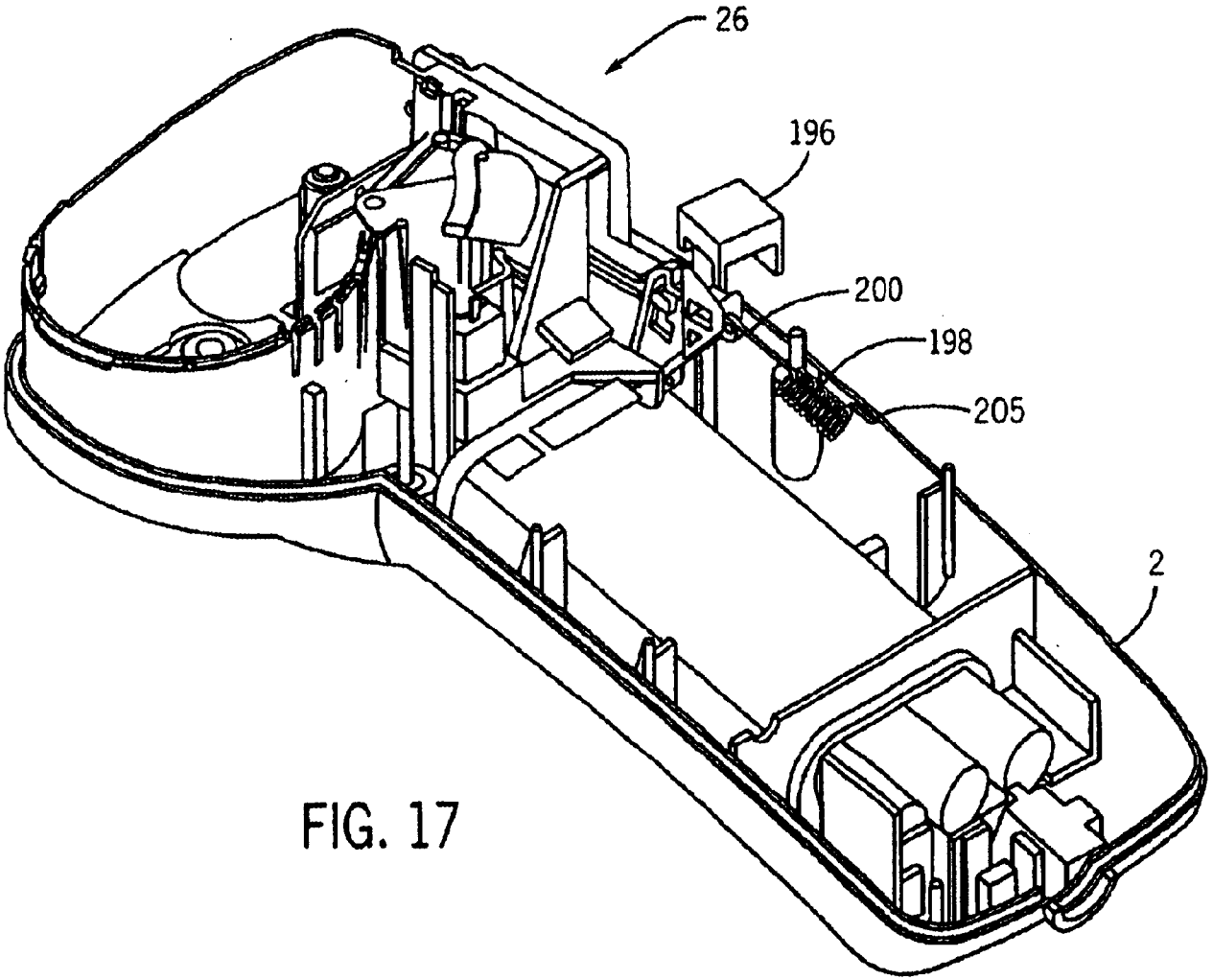
FIG. 17 is a top perspective view of the printer with the housing top half removed.
Figure 18:
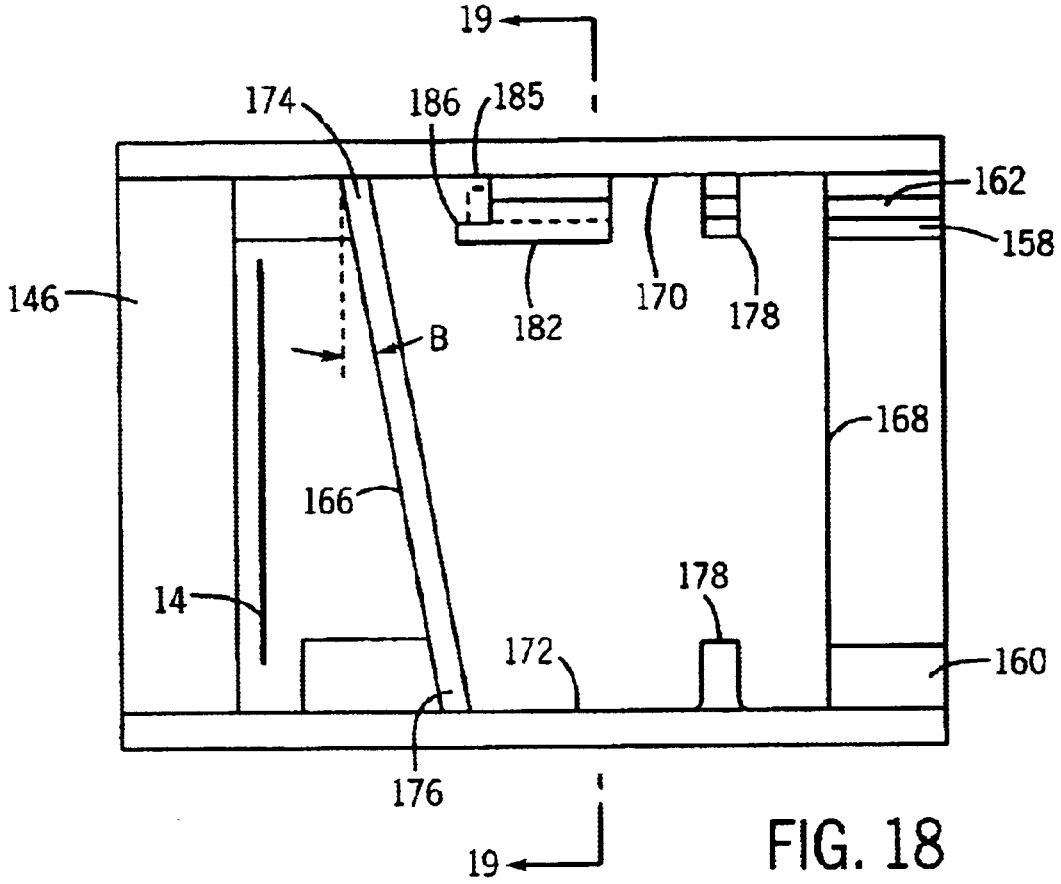
FIG. 18 is a side view of the cutter mechanism of FIG. 15 with the cover removed and the cutter blade in the retracted position.
Figure 19:
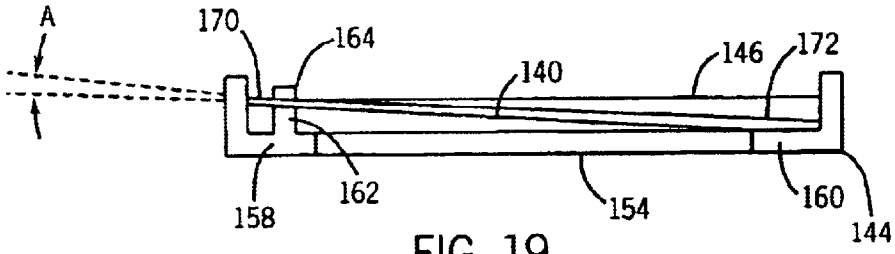
FIG. 19 is a sectional view along line 19—19 of FIG. 18.
Figure 20:
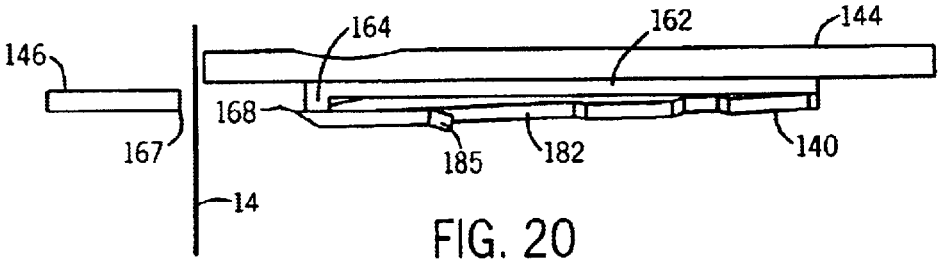
FIG. 20 is a top view of the cutter mechanism of FIG. 18 with the blade in the retracted position.
Figure 21:
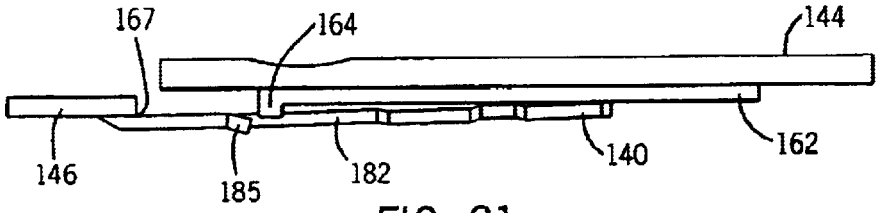
FIG. 21 is a top view of the cutter mechanism of FIG. 18 with the blade in the cutting position.

Referring to FIGS. 14 and 17, a tension spring 198 having one end 200 connected to the pivot arm 192 and an opposing end 205 connected to the printer housing 2 biases the pivot arm 192 toward a retracted position which pulls the blade carriage 142 away from the breaker bar 146 (FIG. 18), and thus the blade 140 toward the retracted position. Although a tension spring 198 is disclosed, other means for biasing the blade 140 toward the retracted position can be used, such as a spring acting directly on the blade or blade carriage, without departing from the scope of the present invention.

Figure 15:
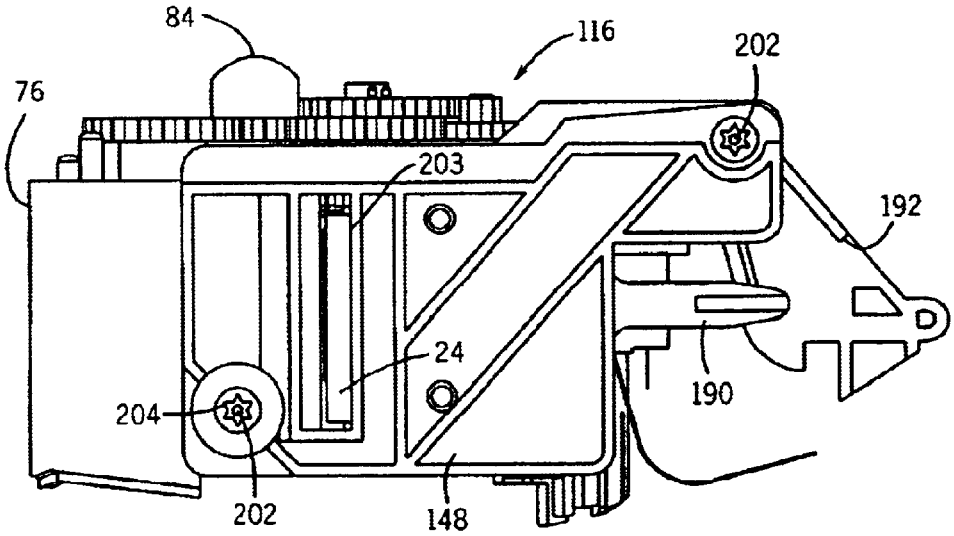
FIG. 15 is a side view of the cutter mechanism of FIG. 3.
Figure 16:
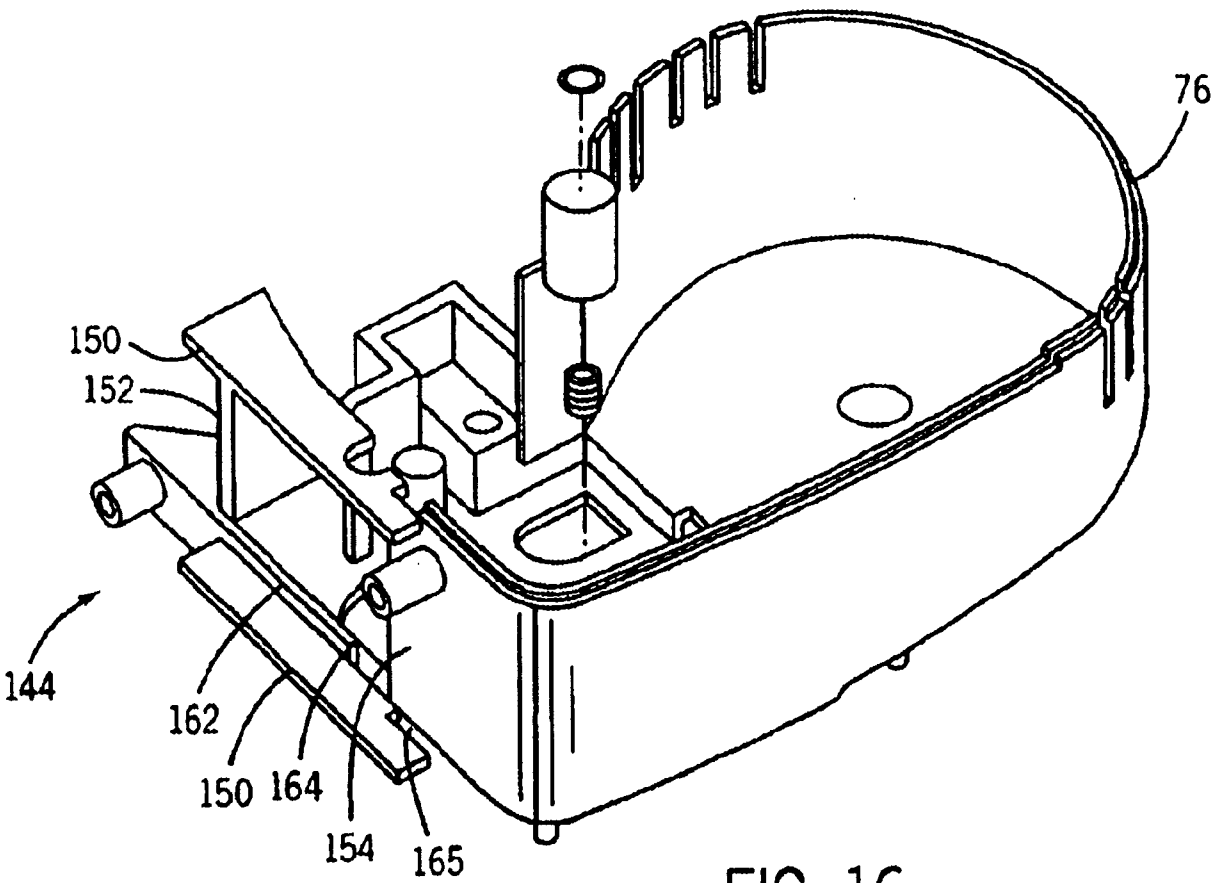
FIG. 16 is a perspective view of the cutter base of FIG. 3.

As shown in FIGS. 10, 14, and 15, the breaker bar 146 and blade carriage 142 are covered by the cutter mechanism cover 148. The cover 148 is fixed to the cutter mechanism base 144 using screws 202 extending through holes 204 formed in the cover 148 and threadably engage the base 144. Although screws 202 are preferred, other means for fixing the cover to the base can be used such as rivets, adhesives, welding, and the like, without departing from the scope of the present invention. A transverse slot 203 formed in the cover 148 guides the labeling media 14 (FIG. 6) along the media path out of the printer housing slot 74 (shown in FIG. 3).

Referring to FIGS. 7, 10, 14–21, in use, printed labels are advanced along the web path through the cutter mechanism 26 between the cutter blade 140 and breaker bar 146. A user urges the lever arm 196 in a forwardly direction to urge the cutter blade 140 toward the breaker bar 146 along the cutting path. As the cutter blade 140 approaches the breaker bar 146, the projection 164 engaging the cutter blade 140 engages the ramp 185 disposed at the leading end 186 of the slot 182 formed in the cutter blade 140. The ramp 185 smoothly transitions the projection 164 into the slot 182 as the helical springs 193 urge the cutter blade 140 in a direction perpendicular to the longitudinal direction to engage the blade leading edge corner 174 with the breaker bar 146 in the cutting position. The cutter blade 140 continues to move toward the forward position while maintaining a point contact with the breaker bar 146 with sufficient pressure against the breaker bar 146 to efficiently cut the labeling media 14.

Once the cutting operation is complete, the user releases the lever arm 196, and the cutter blade 140 is urged toward the retracted position by the tension spring 198. As the cutter blade 140 retracts from the breaker bar 146, the projection 164 received in the slot 182 engages the ramp 185. The ramp 185 smoothly transitions the projection 164 out of the slot 182, and urges the blade 140 against the helical springs 193 to move the cutter blade 140 in a direction perpendicular to the longitudinal direction and disengage the blade 140 from the breaker bar 146.

While there has been shown and described what is at present considered the preferred embodiment of the invention, it will be obvious to those skilled in the art that various changes and modifications can be made therein without departing from the scope of the invention defined by the appended claims. For example, a slot can be formed adjacent both lateral edges of the cutter blade which receive corresponding projections formed in the base to eliminate the blade pivoting about a lateral edge.

We claim:

1. A method for cutting material passing between a cutting blade and a breaker bar, wherein said cutting blade is slidably movable along a cutting path in a base, said method comprising:

urging said cutting blade toward said breaker bar along the cutting path;

urging said cutting blade away from said breaker bar in a direction not parallel to the cutting path with a projection interposed between the cutting blade and the base to prevent engagement of said breaker bar with said blade until said blade overlaps said breaker bar; and biasing said cutting blade toward said breaker bar to engage said blade with said breaker bar.

2. A cutter mechanism for use in a printer, said cutter mechanism comprising:

a base;

a cutter blade slidably fixed relative to said base and movable along a cutting path in a first direction between a retracted position and a forward position through a cutting position;

a breaker bar fixed relative to said cutter blade, said breaker bar being spaced from said cutter blade when said cutter blade is in the retracted position to define a web path between said breaker bar and said base; and a projection extending from one of said base and said blade and engaging the other of said base and said blade to urge said blade in a second direction away from said breaker bar, wherein said second direction is not parallel to said first direction and said projection disengages from the other of said base and said blade when said blade reaches the cutting position to allow said blade to engage said breaker bar.

3. The cutter mechanism as in claim 2, in which said second direction is substantially perpendicular to said first direction.

4. The cutter mechanism as in claim 2, including a biasing member urging said blade against said breaker bar.

5. The cutter mechanism as in claim 2, in which said projection is received in a slot formed in the other of said blade and said base to allow said blade to engage said breaker bar in said cutting position.

6. The cutter mechanism as in claim 2, in which said cutter blade defines an angle with said breaker bar.

7. The cutter mechanism as in claim 2, including a blade carriage driving said blade in said first direction and allowing movement of said cutter blade in said second direction.

8. A cutter mechanism for use in a printer, said cutter mechanism comprising:

a base;

a cutter blade slidably fixed relative to said base and movable along a cutting path in a first direction between a retracted position and a forward position through a cutting position;

a breaker bar fixed relative to said cutter blade, said breaker bar being spaced from said cutter blade when said cutter blade is in the retracted position to define a web path between said breaker bar and said base; and a projection extending from one of said base and said blade and engaging the other of said base and said blade to urge said blade in a second direction away from said breaker bar, wherein said second direction is not parallel to said first direction and said projection engages said blade proximal a lateral edge of said blade to urge said blade lateral edge away from said base and pivot said blade about an opposing lateral edge of said blade as said blade moves between the retracted position and the forward position.

9. The cutter mechanism as in claim 8, in which said blade includes a cutting edge which is not parallel to said breaker bar to form a cutting edge having a leading corner and a trailing corner, and said projection engages said blade proximal said lateral edge of said blade defining an edge of said leading corner.

10. A cutter mechanism for use in a printer, said cutter mechanism comprising:

a base;

a cutter blade slidably fixed relative to said base and movable along a cutting path in a first direction between a retracted position and a forward position through a cutting position;

a breaker bar fixed relative to said cutter blade, said breaker bar being spaced from said cutter blade when said cutter blade is in the retracted position to define a web path between said breaker bar and said base;

a projection interposed between said blade and said base, and urging said blade in a second direction away from said breaker bar, wherein said second direction is not parallel to said first direction, and said projection is received in a slot formed in one of said base and said blade when said blade reaches the cutting position to allow said blade to engage said breaker bar; and a biasing member urging said blade against said breaker bar.

11. The cutter mechanism as in claim 10, which said second direction is substantially perpendicular to said first direction.

12. The cutter mechanism as in claim 10, which said projection extending projection extends from one of said base and said blade engaging said blade.

13. The cutter mechanism as in claim 10, in which said projection engages said blade proximal a lateral edge of said blade to space said blade lateral edge away from said base and pivot said blade about an opposing lateral edge of said blade as said blade moves between the retracted position and the forward position.

14. The cutter mechanism as in claim 13, in which said blade includes a cutting edge which is not parallel to said breaker bar to form a cutting edge having a leading corner and a trailing corner, and said projection engages said blade proximal said lateral edge of said blade defining an edge of said leading corner.

15. The cutter mechanism as in claim 10, in which said cutter blade is not parallel to said breaker bar.

16. The cutter mechanism as in claim 10, including a blade carriage driving said blade in said first direction and allowing movement of said cutter blade in said second direction.

* * * * *